US005457930A

United States Patent [19]

Dauder-Guardiola

[11] Patent Number: 5,457,930

[45] Date of Patent: Oct. 17, 1995

[54] MACHINE FOR FILLING RETICULATE SACKS HAVING CLOSING AND HOLDING BANDS OR THE LIKE

[75] Inventor: Agustin Dauder-Guardiola, Badalona, Spain

[73] Assignee: Talleres Daumar S.A., Barcelona, Spain

[21] Appl. No.: 264,935

[22] Filed: Jun. 24, 1994

[30] Foreign Application Priority Data

Jun. 29, 1993 [ES] Spain ..... 9301457

[51] Int. Cl.[6] ..... B65B 1/22; B65B 7/02; B65B 39/06; B65B 39/12

[52] U.S. Cl. ..... 53/138.3; 53/138.7; 53/139.2; 53/571; 53/573; 141/12; 141/114

[58] Field of Search ..... 53/134.1, 134.2, 53/137.2, 138.6, 139.4, 571, 573, 384; 141/12, 114

[56] References Cited

U.S. PATENT DOCUMENTS

| | | | |
|---|---|---|---|
| 2,630,954 | 3/1953 | Carter et al. | 53/571 |
| 2,722,358 | 11/1955 | Wilson | 53/571 X |
| 2,833,097 | 5/1958 | Petrea et al. | 53/571 |
| 3,483,801 | 12/1969 | Kupcikevicius | 53/134.1 |
| 3,495,378 | 2/1970 | Kipers | 53/571 |
| 3,498,020 | 3/1970 | Eppenberger | 53/571 X |
| 3,509,689 | 5/1970 | Perrin | 53/571 |
| 3,961,461 | 6/1976 | Ruf et al. | 53/571 |
| 4,044,450 | 8/1977 | Raudys et al. | 53/134.1 |
| 4,165,593 | 8/1979 | Niedecker | 53/134.1 |
| 5,029,728 | 7/1991 | Su | 53/571 X |

*Primary Examiner*—Horace M. Culver

[57] ABSTRACT

A machine for filling reticulate sacks having closing and holding bands, or the like, has a turning support with four crossed arms. Each arm having two vertical blades. Four stations are located about the support. A first station carries the sacks to the blades. A second station forms a loop and delivers the sack to a suspension device. A third station fills the sack. A fourth station closes the mouth of the sack and fixes such. The machine further includes an initial sack holding device, a loop forming device, a suspension device for each sack arranged at the four arms of the turning support, a hopper unloading the products into the sack and a vertically displaceable platform. A fixing device for the closure of the sack and a device for unleashing the loop on the band from the suspension device are also provided.

19 Claims, 11 Drawing Sheets

MACHINE FOR FILLING RETICULATE SACKS HAVING CLOSING AND HOLDING BANDS OR THE LIKE

FIELD OF THE INVENTION

The object of the present invention is a machine for filling reticulate sacks having closing and holding bands or the like with which this operation is fully automatic, which sacks can be filled with any kind of product whatsoever.

BACKGROUND OF THE INVENTION

There are known sacks made of plastic or natural material (paper or vegetable matter) forming a reticular tissue, which usually has a rectangular mesh, the mouth of the sacks being provided with linear flexible closing and holding means such as bands, ropes or strings, with which the sacks are closed once they have been filled with the required products, after a relative movement between the closing means and the mouth of the sacks, which is contracted to form folds or creases, whereupon clamps, seals or other conventional means are used to consolidate the closure of the previously filled sacks, which are then ready to be marketed and have an appropriate handle.

These sacks can have many different sizes, taking sacks to include bags, subject to their characteristics being as above, and the sacks can in any event carry suitable reinforcements at certain of their portions to resist the mechanical strain stemming from the weight to be borne and the actual handling and use thereof.

There were heretofore three systems for manipulating the sacks to be filled with the required products and their mouths later closed:

1) An operator places the open sack under a hopper by hand, the hopper unloads the product for such time and in such amount as may be required for the sack to be filled, unloading being carried out at will through a control activated by the operator.

2) An operator places the open sack under a semi-automatic machine clip, which machine has sack receiving means and holds its mouth by action of the operator, and a horizontal rotatory support and many stations at which the sacks are received as described, then fill and weigh, then at another station another operator pulls the band and hangs each sack from a hook, and at a final station another operator finally closes the sack availing of conventional means, such as clamps and the like.

3) And a variant of system 2) in which a semi-automatic machine which resembles the above machine is used, albeit with the machine finally closing the sack with a clamp.

The three prior art systems use a lot of labor, with the cost and time this entails and with a relatively low industrial yield, to the extent that the hourly production is dependent upon the skill of the operators involved in each of the systems.

SUMMARY OF THE INVENTION

In order to overcome the drawbacks arising from the three known systems to handle the aforesaid sacks and fill the same with the required products before definitively sealing their mouths, this invention proposes a machine for filling reticulate sacks having closing and holding bands or the like, which bands comprise linear, continuous and flexible closing means for the mouth of the sack, acting to cause a relative movement between such means and the mouth of the sack, and also constituting handles. This machine is characterised by comprising:

a) A horizontal support held and piloted on the bed of the machine, turning about its vertical center line due to the intermittent action of drive means fixed to the bed, which turning support comprises a framework with four identical arms forming a cross, each of which has attached to its free end a first suspended vertical blade lying at a right angle to its respective arm, with a second vertical blade facing and lying parallel to the same suspended, piloted and horizontally displaceable by corresponding drive means, along the horizontal center line of such arm and against the antagonist action of resilient means;

b) four stations located at the ends of a theoretical cross with like arms and located on the bed around the horizontal turning support: a station receiving each sack, lifting and delivering the sack to the corresponding pair of vertical blades on the turning support, the sacks being arranged horizontally forming a vertical pile; a station for forming a sort of outwardly projecting loop on the closing band or the like in every sack and delivering the loop to means for suspending the same; a station for supporting each sack temporarily from below and filling the same with the required products; and a station closing the mouth of each sack and fixing the closure with means applied to the band or the like;

c) means for holding the sack externally at its mouth comprising tabs travelling horizontally or clamps, which holding means are mounted upon the bed and joined to means for their vertical travel; and a rocking arm, governed by drive means, accompanying the sack held by such holding means, which arm is jointed at the top to a horizontal shaft lying at a right angle to the vertical center line on the turning support;

d) means forming the projecting loop on the band or the like closing each sack, comprising a support with a tab that is horizontally displaceable by drive means, which support is joined to a horizontal plate that is vertically displaceable by drive means and piloted on a top platform, joined to the bed and upon which the plate drive means are mounted, which plate carries vertical linear drive means;

e) means for suspending the sacks through the loop on the band or the like, mounted and piloted on the four arms of the framework of the turning horizontal support and vertically displaceable by such vertical linear drive means of the plate against the antagonist action of resilient means;

f) a hopper unloading the products into each sack arranged beneath the same, which has a gate at the mouth for the outlet of the products, swinging by drive means; and a vertically displaceable platform by drive means, located beneath the hopper and for the bottom of each sack to be temporarily supported, which can also be fitted with vibratory means;

g) means for fixing the closure of the mouth in each sack, mounted to oscillate about a vertical shaft joined to the bed and applicable to the band or the like in the sack by drive means, with the assistance of a vertical pilot-support fixed to the bed; and means for unleashing the loop on the band of the sack from the means suspending the same, comprising vertical linear drive means for such suspension means mounted upon the bed, moving the same down against the antagonist action of the resilient means parallel to such pilot-support;

h) and means for collecting the full sacks, definitely closed and with their respective handle defined initially by the loop on their aforesaid band or the like.

The machine for filling reticulate sacks having bands or like closing and holding elements subject of the present invention eliminates the above drawbacks and provides, among other, the advantages of full automation of the filling of such reticulate sacks with the required products and of the closing and fixing thereof, almost entirely eliminating the labor and providing a significant time savings and industrial yield.

The machine of the invention affords the above advantages, in addition to others that will be easily inferred from the embodiment of the machine described hereinafter, to expedite the understanding of the characteristics set out above and at the same time revealing a number of details thereof, a number of drawings being attached to such end which merely illustrate and do not limit the scope of the invention, representing a practical embodiment of the aforesaid machine for filling reticulate sacks having bands or like closing and holding means.

BRIEF DESCRIPTION OF THE DRAWINGS

The drawings are schematic but sufficient to illustrate the machine.

DESCRIPTION OF AN EMBODIMENT OF THE INVENTION

Figure 1:
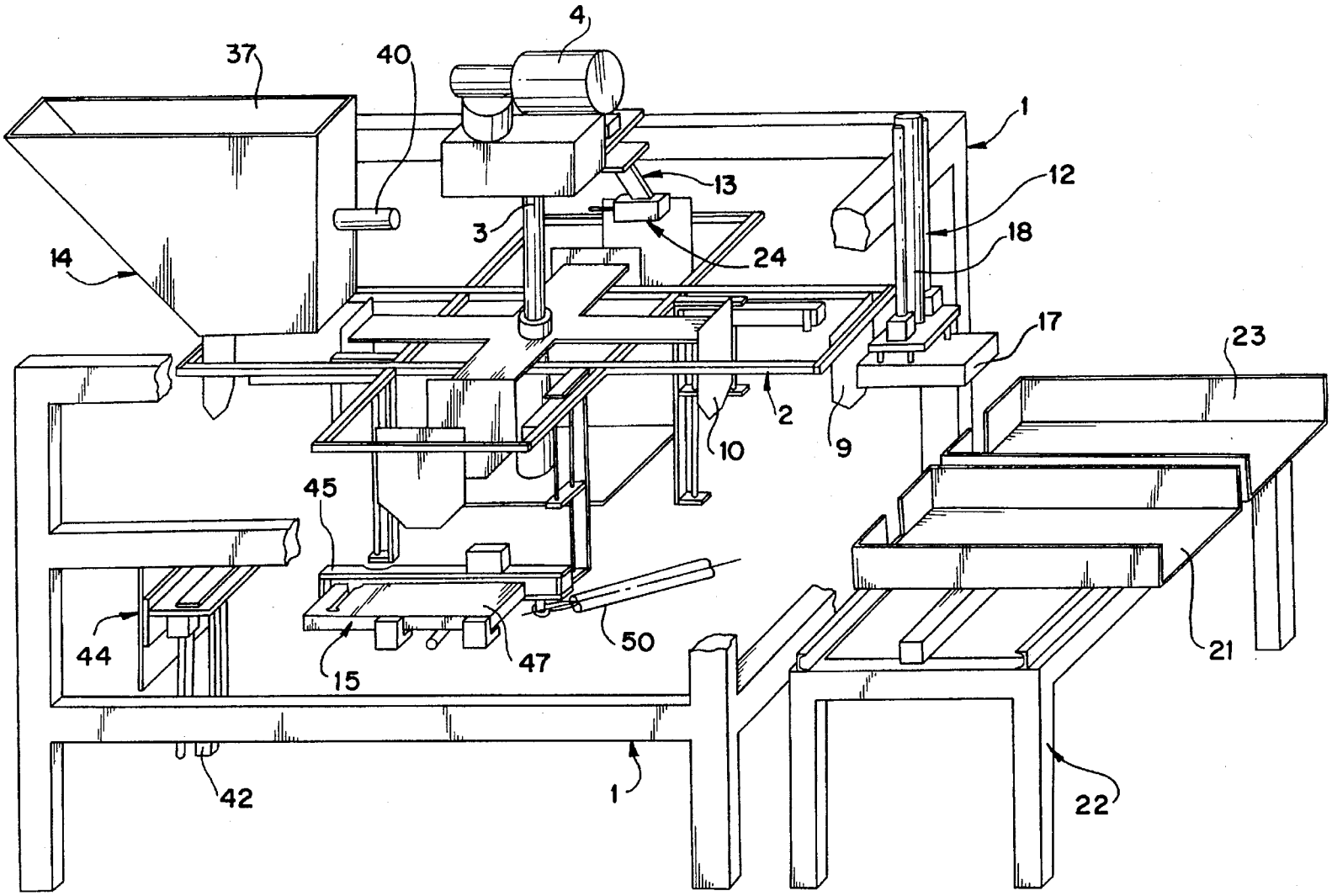
FIG. 1 shows a perspective view of the machine.
Figure 2:
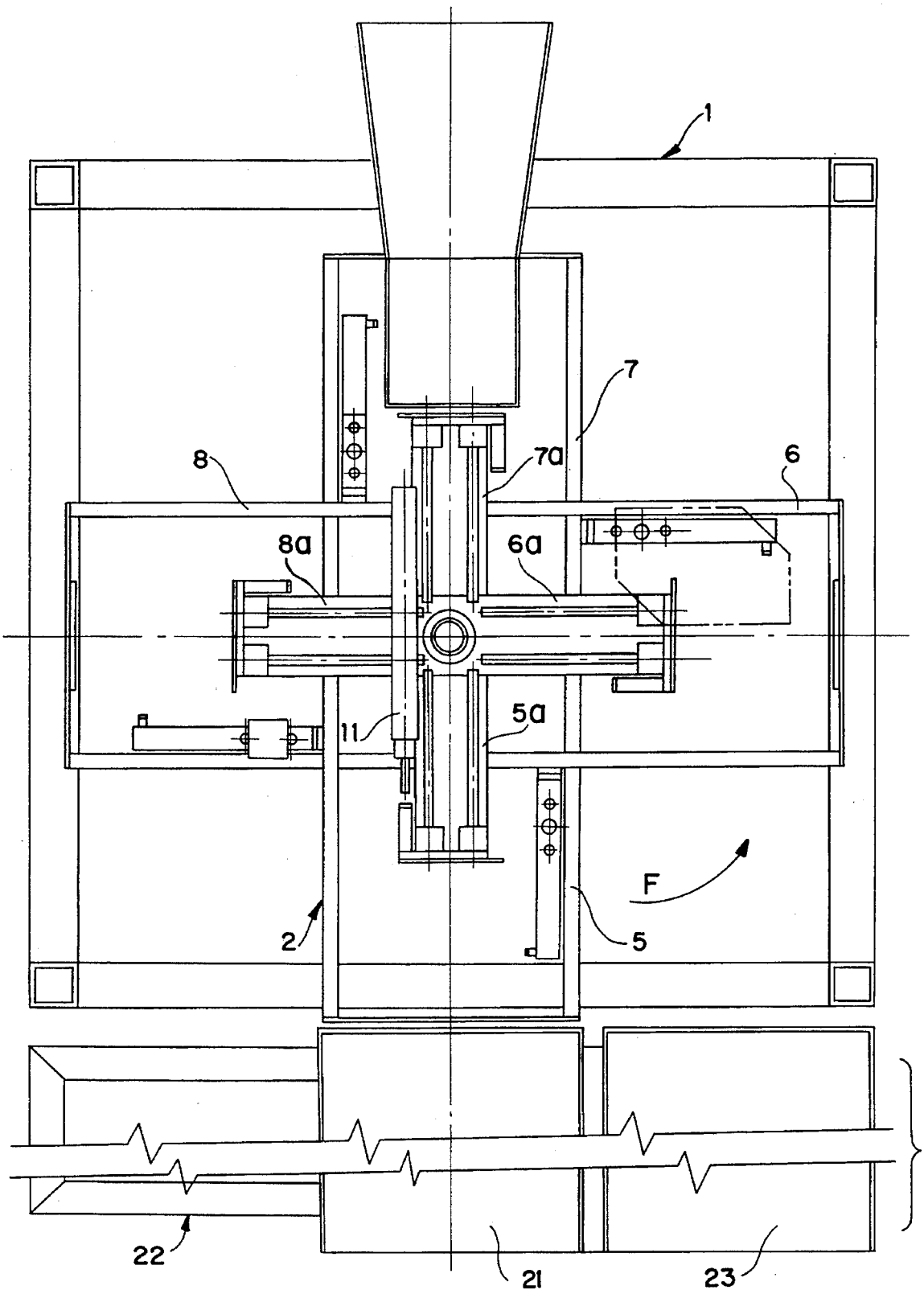
FIG. 2 is a plan view of the machine.

In accordance with the drawings, the machine filling reticulate sacks having closing and holding bands or the like, has a bed generally numbered -1- in FIGS. 1, 2 to 6, and 10 to 12. This machine has a horizontal support -2- (FIGS. 1, 2 to 6 and 10 to 12) held suspended from and piloted in the bed -1- of the machine and turning about its vertical center line, which materialises as a vertical shaft -3- piloted in and supported by bearing means (not shown) with its fixed portion joined to the bed, which shaft is turned by a motor -4- fitted, as appropriate, with a reducer and having means causing the said shaft to be intermittently driven in order for the turning support -2- to turn step-by-step. In other words, support 2 is angularly displaced from station to station and is stopped for a certain time in order for the relevant operations to be carried out at each station.

The turning support -2- comprises a framework (FIGS. 1 and in particular 2) having four identical arms -5-, -6-, -7- and -8- forming a cross, being in this embodiment pairs of structures -5- and -5*a*-, -6- and -6*a*-, -7- and -7*a*- and -8- and -8*a*-, joined to each other about the shaft -3- from which the turning support -2- hangs. Each of the said four arms and particularly at the free end of each of structures -5-, -6-, -7- and -8- carry a first vertical suspended blade -9- located at a right angle to its respective arm (FIGS. 1, 3 to 6 and 10 to 12). And the first blade carries facing and parallel to it a second blade -10- that is also vertical and suspended but is piloted and horizontally displaceable by corresponding drive means such as the horizontal pneumatic cylinder -11-, which displacement is along the center line of the relevant arm and against the antagonist action of resilient means (not shown) which tend to hold the second blade -10- in its furthermost position from the first blade -9- lying parallel to the same on each arm. Every first blade -9- is fixed at the corresponding structure -5-, -6-, -7- and -8- whereas every second blade -10- is mounted to travel along tracks (by means of two horizontal rods fixed to the plate) on the corresponding structure -5*a*-, -6*a*-, -7*a*- and -8*a*-. The horizontal cylinder -11- is mounted fixed upon the bed -1- and in line with the station receiving every sack to be delivered to the pair of blades that will in due course face the station, with the stem projecting from the same pushing the second blade -10- in due course towards the station as described hereinafter.

This machine has four stations located at the ends of a theoretical cross with like arms and located on the bed around the turning support -2-. One of the stations is the station -12- receiving each sack, lifting and delivering the same to the corresponding pair of vertical blades -9- and -10- on the arm on the turning support facing the station at the time. Another station is the station -13- forming a sort of loop projecting from the closing band or the like in every sack delivering the loop to means for suspending the same. Another station is the station -14- supporting each sack and filling the same with the required products. Finally another station is the station -15- closing and fixing the closure on the mouth of every sack. The fixing takes place with means applied to the band or the like on the sack. The stations -12- to -15- are shown generally in FIGS. 1, 3 to 13, 15, 17 and 19.

Figure 3:
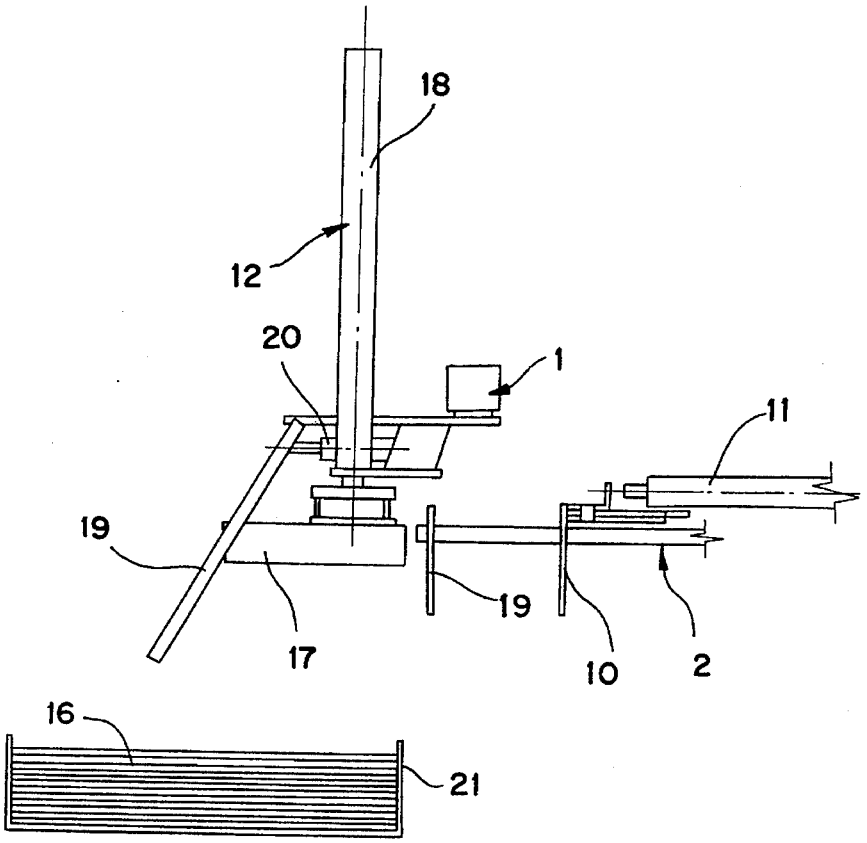
FIGS. 3, 4, 5 and 6 relate to the station receiving each sack, lifting and delivering the same to the corresponding pair of vertical blades in the turning support of the machine, during operative stages at such station.
Figure 4:
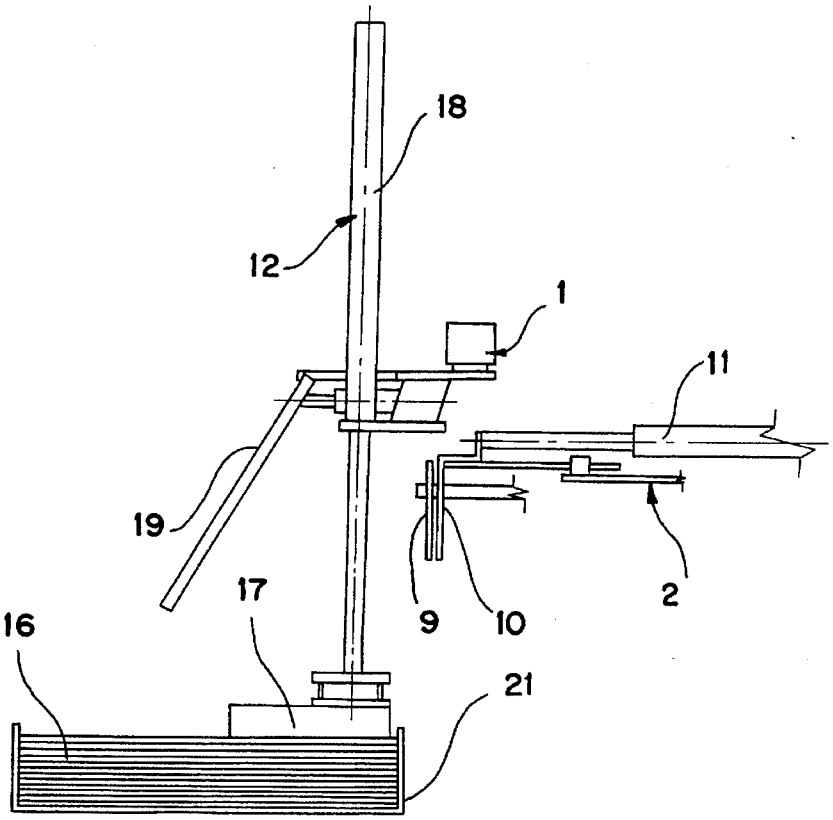

The station -12- receiving, lifting and delivering every sack, such as the sack -16- (FIGS. 3 to 6, of which FIGS. 3 and 4 show the sack as the first of a vertical pile of sacks laying horizontally) has means -17- for holding the sack -16- externally at its mouth comprising a variable number of horizontally displaceable tabs lying parallel to each other (the ideal number has been tested at 3 or 5) or a likewise variable number of clamps as before. The tabs can be arranged along and parallel to the band of the sack or across the same, the tabs or clamps being governed, in order to pass through the threads in the mesh of the reticulate tissue of the sack, by corresponding mechanical, electrical, pneumatic, hydraulic or combined drive means (not shown just as the tabs or clamps are not shown). The holding means are joined to means for vertical travel thereof which in this embodiment comprise a vertical cylinder -18- mounted upon the bed, with its stem joined at the bottom to the holding means -17-, this cylinder being pneumatic or hydraulic. The vertical travel means for the holding means -17- can also be any other suitable vertical linear drive means whatsoever.

A rocking arm -19- is also provided, governed by drive means which in this embodiment comprise a horizontal cylinder -20-, with its stem jointed to the rocking arm -19- below the joint between the latter and machine bed. The cylinder -20- is also linked to such bed, and hence the aforesaid arm is jointed at the top to a horizontal shaft that lies at a right angle to the vertical center line of the turning support -2- and is therefore also at a right angle to the longitudinal center line of the arm of said turning support which shall face the station -12- at the time.

FIG. 3 shows the initial operating position of the machine, with the two vertical blades -9- lying furthest from each other (such is usually the position at rest), the holding means -17- being at their highest point and the rocking arm -19- set askew outside the machine. FIG. 4 shows how the vertical blade -10- is pushed by the horizontal cylinder -11- until it is almost juxtaposed to the vertical blade -9-, the cylinder -11- having overcome the antagonist action of the resilient means to which the travelling blade -10- is permanently submitted, and the holding means -17- are lowered by the cylinder stem -18- to establish contact with the first sack -16- on the vertical pile of sacks. All of the sacks are located horizontally in a bucket -21- which serves as a store for the sacks arranged as above and which can form part of machine feeding means (shown schematically in FIGS. 1 and 2). This feeding means comprises another frame -22- to slidably support the bucket -21- and preferably another identical bucket -23-. Each of the two buckets being alternately located under the sack receiving station -12- until emptied, at which time the other bucket (previously filled with sacks) shall move, preferably automatically, until it is located under such station, whereupon the empty bucket shall be filled with sacks arranged horizontally one above each other to form a vertical pile.

Figure 5:
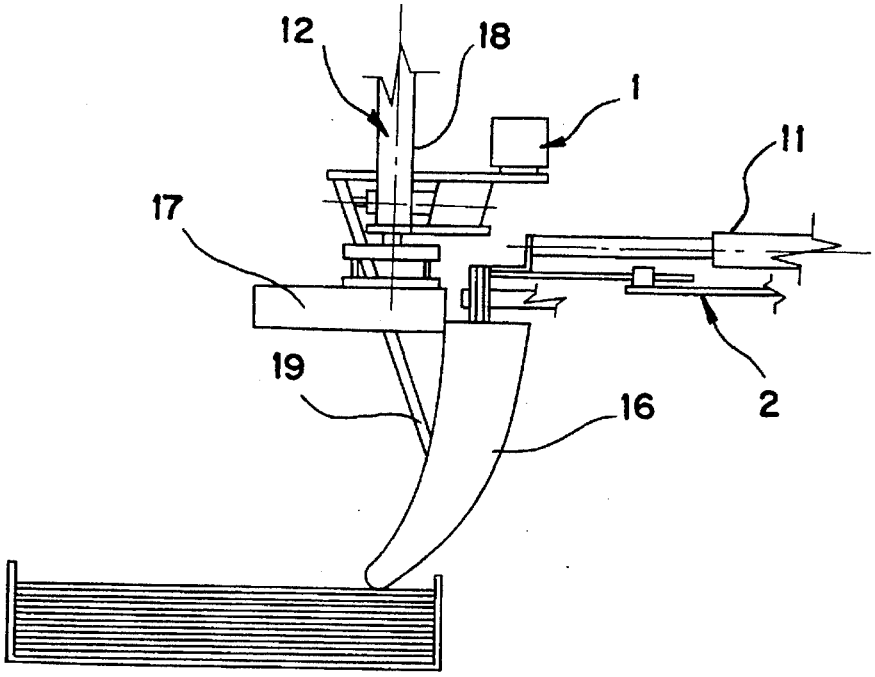
Figure 6:
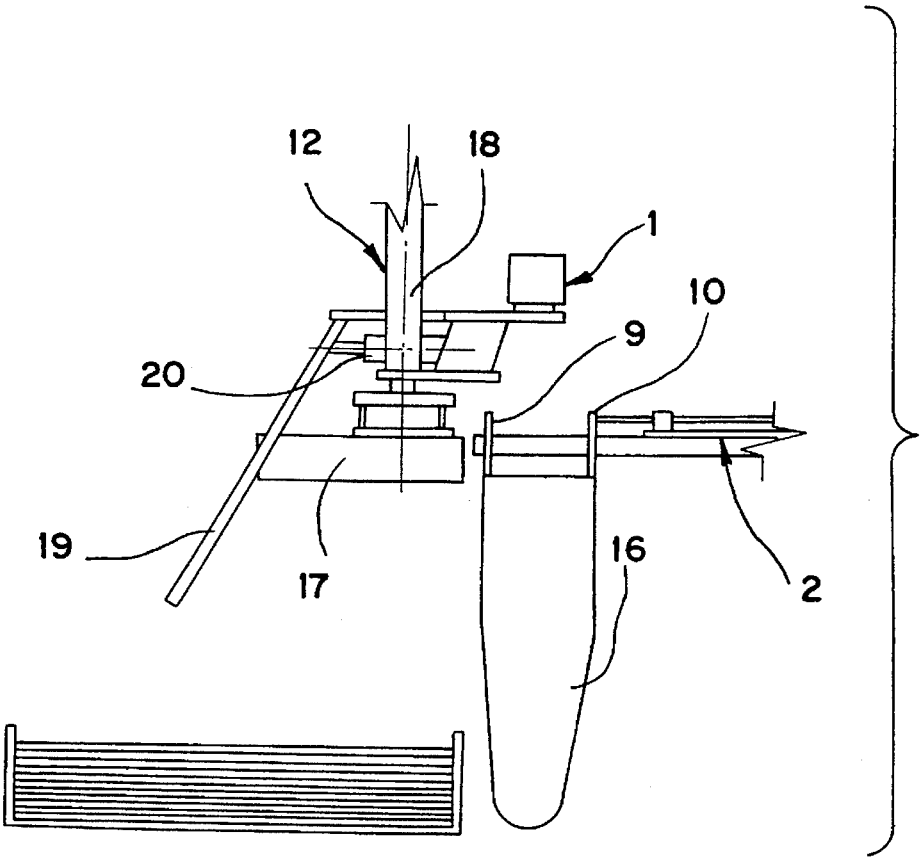

At the operative stage of the station -12-, as shown in FIG. 4, the tabs or clamps of the holding means -17- are activated thereby to hold the sack -16- externally at its mouth and specifically at the area where the sack closing and holding band is arranged. The holding means -17- (FIG. 5) are then raised by action of the cylinder -18- thereby lifting the sack -16- held at its mouth by the holding means, and the sack is at the same time accompanied by the rocking arm -19- to expedite its positioning and transfer to the pair of blades -9- and -10-, to which end the rocking arm turns as shown in FIG. 5 by action of the horizontal cylinder stem -20-. As shown in FIG. 6, the horizontal cylinder -11- finally releases the second blade -10- (with its stem moving back) which will by action of its antagonist resilient means move away from the first blade -9- and both blades shall hold the mouth of the sack firmly and internally, and the holding means -17- shall contemporaneously release their tabs or clamps and the sack will thus hang from the pair of blades -9- and -10- as shown in FIG. 6.

The motor -4- then causes the shaft -3- and hence the turning support -3- to turn in such a way that the arm that was facing the said station -12- shall travel angularly, in this example anticlockwise with the support seen from the top (though it would turn clockwise if the stations were located in that direction) until it faces the loop forming station -13- (FIGS. 7 to 9) and the support stops for whatever time is required, at any rate very little, for operations to be carried out at that station.

Figure 7:
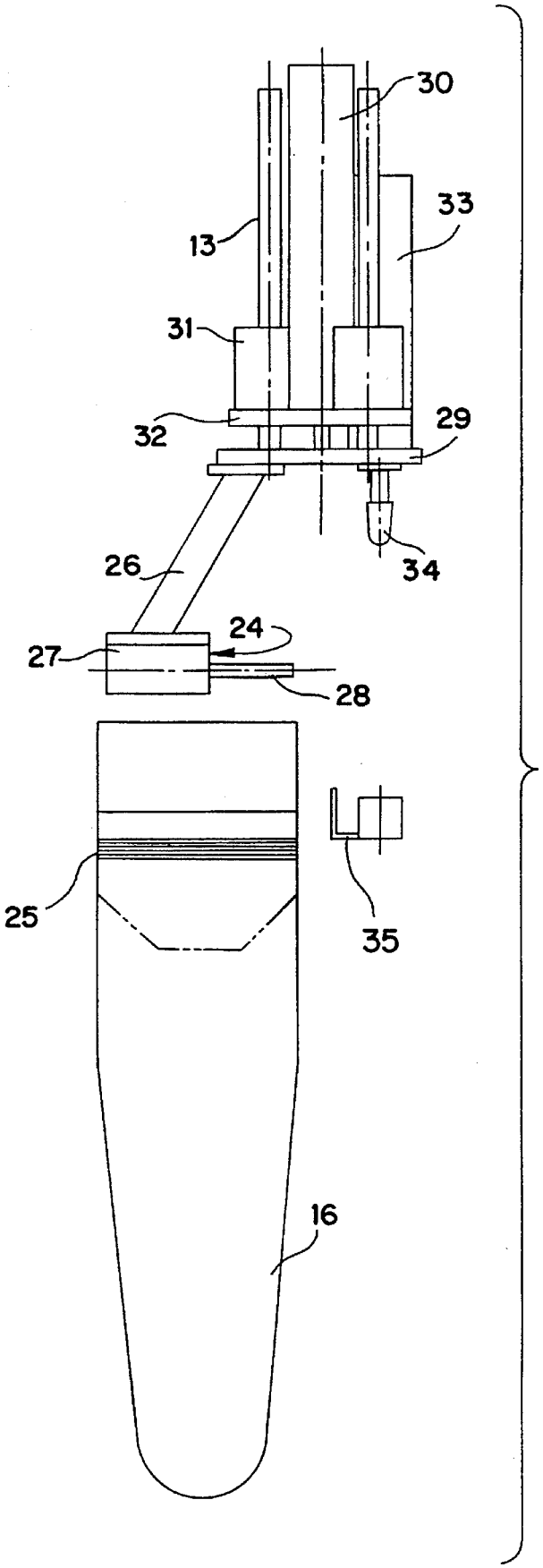
FIGS. 7, 8 and 9 show the station forming a loop out of the band or the like to close each sack and delivering such loop to means for hanging the same, during three operative stages at such station, noteworthy being that FIG. 8 shows an inside view of the sack.
Figure 8:
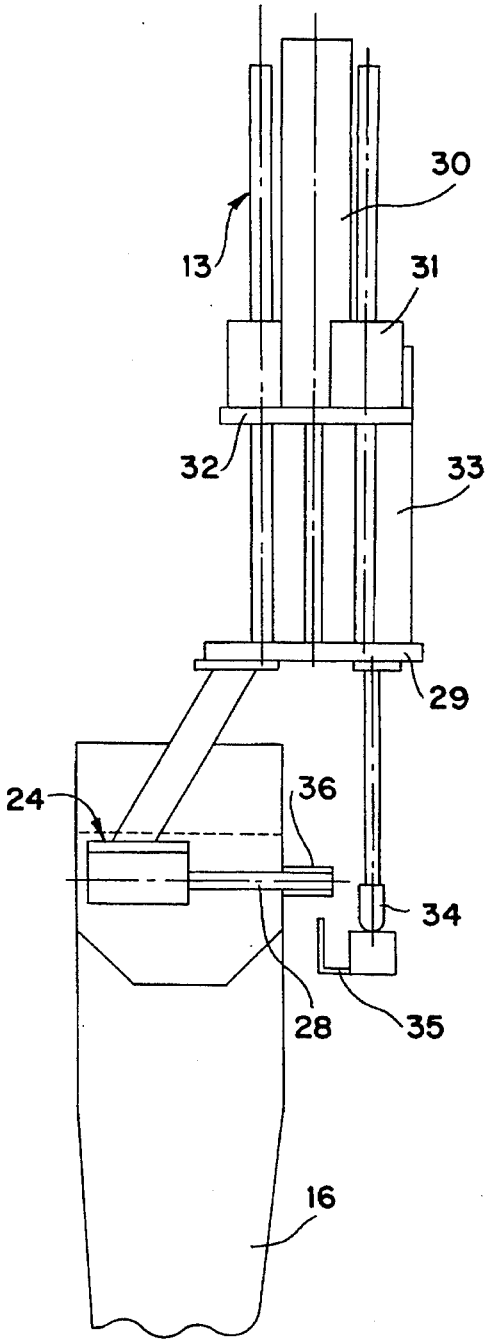
Figure 9:
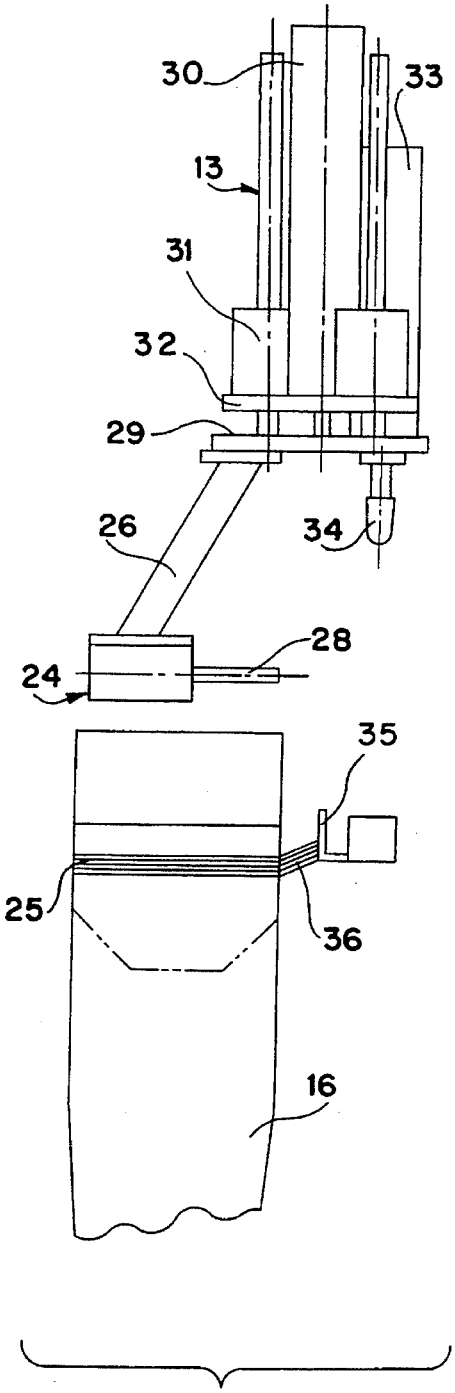

The station -13- has forming means -24- (see in particular FIG. 7 and also FIGS. 8 and 9). It should be noted that these FIGS. 7 to 9 do not show the blades -9- and -10- holding the mouth of the sack open, for the sake of clarity, and that FIG. 8 shows the forming means -24- from inside the sack. Forming means -24- forms a loop -36- which projects from the closing band -25- or the like in each sack -16-. These forming means comprise a support -26- to which drive means -27- are joined governing horizontal travel of a tab -28-. The support 26 is joined to a horizontal plate -29- that can travel vertically due to vertical linear drive means, such as the pneumatic or hydraulic cylinder -30-, the horizontal plate -29- being piloted by suitable piloting means -31- joined to a top platform -32-, in turn joined to the bed, which platform holds the plate drive means, specifically the cylinder -30-.

The horizontal plate -29- carries vertical linear drive means -33- such as a pneumatic or hydraulic cylinder, the lower end of which -34- can be lowered when the drive means are activated, to move downwardly against the antagonist action of resilient means (not shown). End -34- will contact means -35-, preferably double hook shaped, for suspending each sack -16- from its loop -36- (FIG. 9) in the band -25- or the like, which loop shall have been obtained with the forming means -24- (FIG. 8). The means -35- for suspending the sacks are mounted and piloted on the four arms of the turning support -2- frame and can be vertically displaced by the lower end -34- of the vertical linear drive means -33- against the antagonist action of the aforesaid resilient means. The hook -35- rises when the lower end -34- rises and is positioned within the loop, the tab -28- being then removed, moving back and rising, as shown in FIG. 9, to reach its initial position of FIG. 7.

Figure 10:
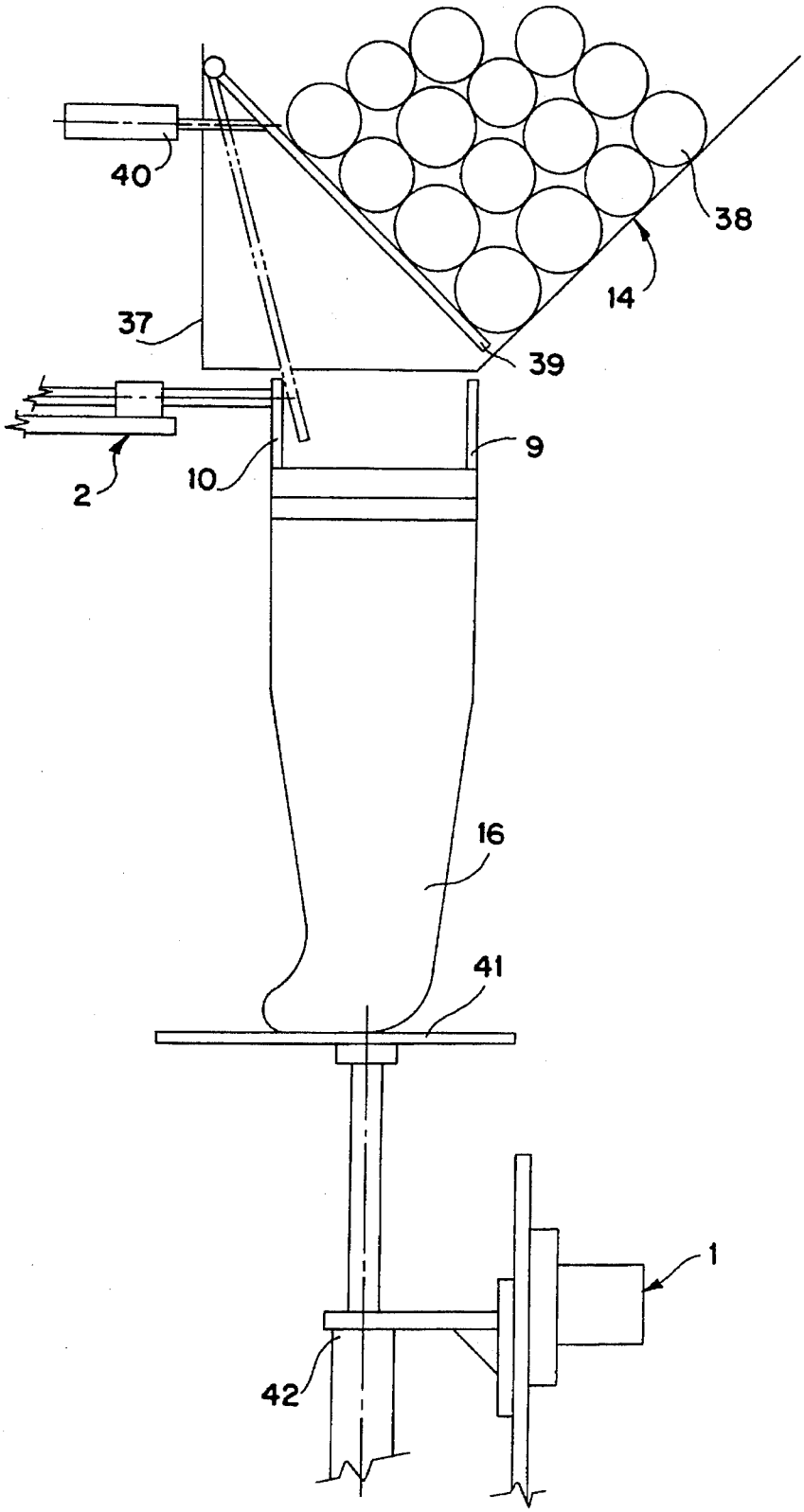
FIGS. 10, 11 and 12 show the lower temporary supporting station of each sack and for filling the sack with the relevant products, FIG. 11 showing the sack filled with the products and seen from the inside.
Figure 11:
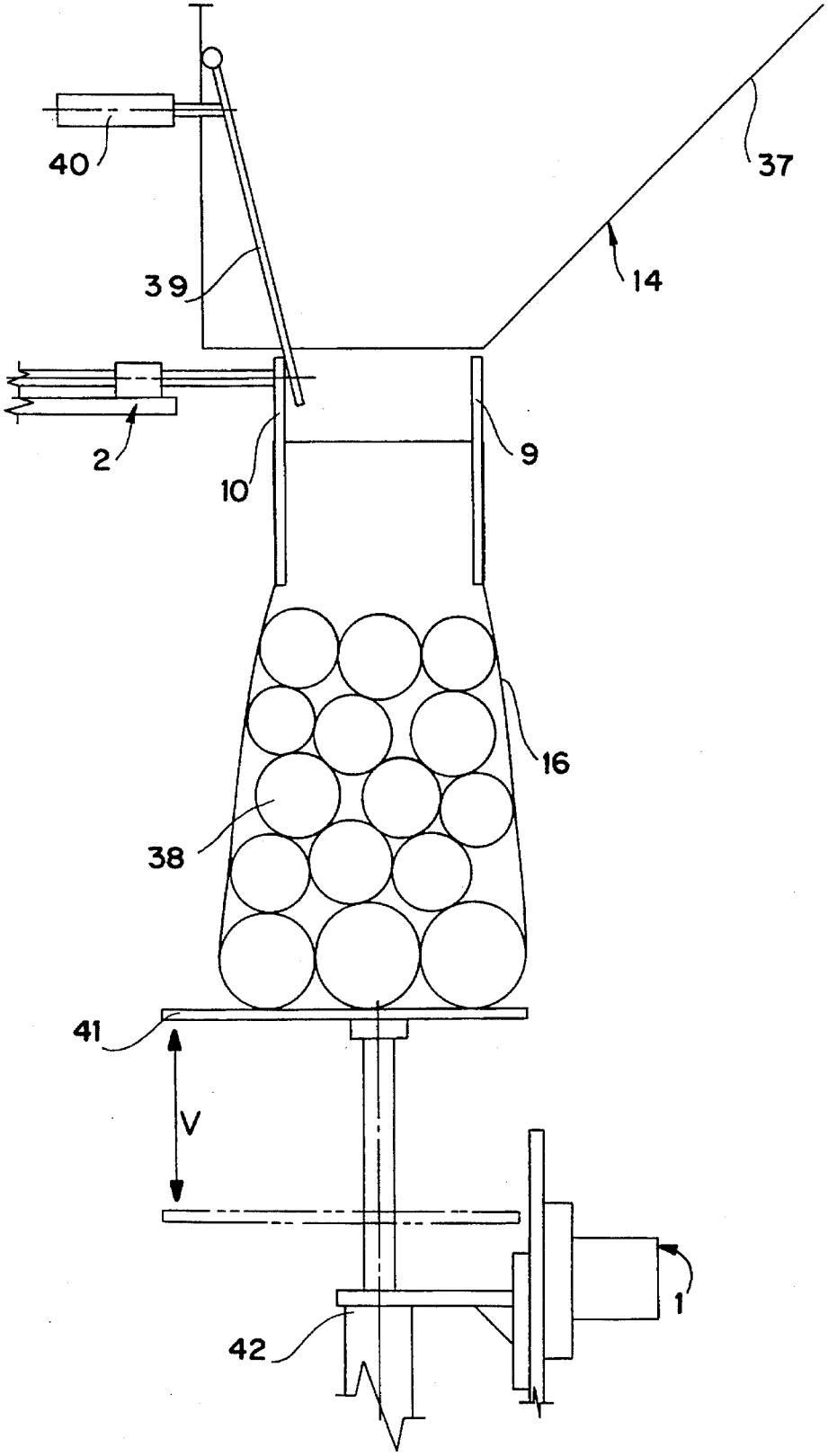
Figure 12:
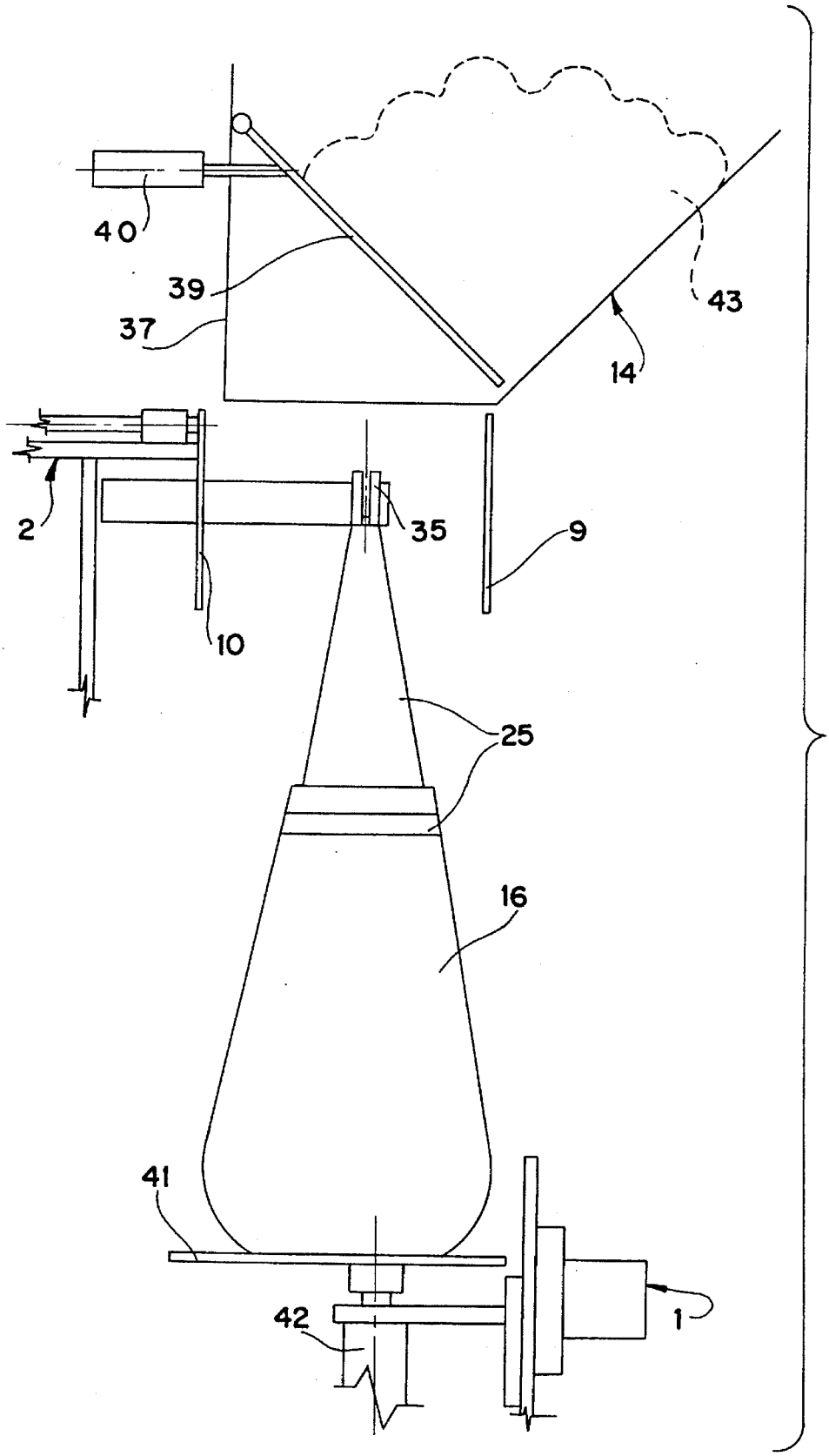
Figure 13:
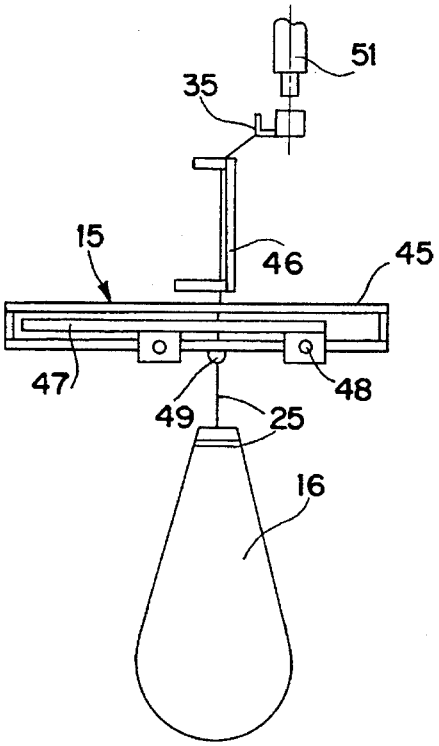
FIGS. 13 to 20 show the station closing the mouth in each sack and fixing the closure, at various operative stages of such station, FIGS. 14, 16, 18 and 20 being plan views of FIGS. 13, 15, 17 and 19.

FIGS. 10, 11 and 12 show a close view of the station -14- for filling the sacks with the requisite products, noteworthy being that FIG. 11 shows the sack -16- in cross section and with the product contained inside. The station has a hopper -37- at which the products -38- are temporarily received and having a gate -39- at its mouth for outlet of such products. The said gate is shown closing the outlet mouth of the hopper in FIGS. 10 and 12 and in the open or unloading position in FIG. 11, FIG. 10 showing the angular travel of such gate -39- from its closed position to its open position (dash line) at which latter position it leans against the inner part of the blade -10-. The gate swings by drive means -40- which in this embodiment comprise a pneumatic or hydraulic cylinder, with its stem linked to such gate to swing the same.

The station -14- also has a platform -41- that can be vertically displaced by drive means -42- which in this embodiment comprise a vertical pneumatic or hydraulic cylinder, with its stem joined at the bottom to the platform -41- to cause it to move up or down as shown in FIGS. 10 to 12. The platform -41- is located below the mouth of the hopper -37- and stands as the lower temporary support for every sack -16-, and can eventually be fitted with vibratory means (not shown but with upward and downward oscillation as schematically shown in FIG. 11 and marked at V).

When the sack hanging from its mouth tied between blades -9- and -10- moves from station -13- to station -14- upon rotation of support -2- and with the hopper -37- full of a preset quantity of products -38- deposited in such hopper from other external means, such as a weighing or other suitable machine, and the bottom of the sack -16- lies upon the platform -41- as shown in FIG. 10, the drive means -40- are activated and the gate -39- opens to take up the position shown in the dash line of FIG. 10, whereupon the set up product units -38- are unloaded into the sack -16- as shown in FIG. 11. The now full sack can eventually be provided through platform -41- with vibrations or rapid upward and downward movements (marked by the arrow V in FIG. 11) to suitably distribute the products inside the sack. Finally, the platform -41- (FIG. 12) is lowered, dragging the now full sack down, the mouth of which slides until it becomes detached from the plates -9- and -10- due to its own weight (these plates hold an empty sack easily but cannot hold a full sack) and hence the movable plate -10- draws away from the fixed plate -9- by action of its resilient means, which move it back to the position furthest from the plate -9-. The mouth of the sack hangs from the suspension or hook means -35- in such a way that its band -25- is stretched and the mouth of the sack is constrained as shown in FIG. 12, although the drawing does not show the creasing that in fact comes about at this stage.

The hopper can also be fitted with vibratory means in order to expedite unloading of the products from the hopper to the sack, and eventually flexible skirts on its lower mouth for the outlet of the products, for a better adjustment to the mouth of the sack, preventing potential spillage of the products while they are unloaded from the hopper to the sack.

The hopper is then loaded with new products -43- (FIG. 12).

The sack -16-, now full and hanging from the hook -35- through its band -25-, travels from the filling station -14- to the closing station -15- by angular rotation of the turning support -2-, stopping at such station -15-, the sack having been further closed as it hangs from the hook -35- and the angular travel takes place without any lower support for the sack, although fixed side tracks are arranged to control the oscillating movement of the sack during such travel. FIGS. 13 to 20 show the closing station -15- in greater detail, which station has means for fixing the closure thus obtained of the mouth of each sack -16- now full, which means are mounted to oscillate about a vertical shaft -44- joined to the bed, which fixing means comprise in this embodiment a lever -45- cinching the mouth of the sack, which is applied against the band -25- therein to finally close the mouth with the assistance of a pilot-support -46- fixed to the bed.

The means fixing the closure of the mouth in every sack comprise not only the cinching lever -45- but means applicable to the band or the like which are in this embodiment a sealing device -47- (such as a clamping device or other suitable fixing means, including welding and the like) that is attached to the cinching plate through tracks -48- fixed to the lever and along which the sealing device can slide parallel to the cinching lever, passing through two parallel and superposed mounting plates on the lever, due to drive means -49- which can comprise a pneumatic or hydraulic cylinder or other suitable means. The oscillating movement of the assembly comprising the cinching lever -45- and the sealing device -47-, viz. the oscillating movement of the fixing means, takes place by action of drive means -50- which in this embodiment comprise a pneumatic or hydraulic cylinder linked to the frame, with its stem reaching the cinching lever -45-, in such a way that the outlet of the said stem from the body of the cylinder causes the angular rotation of the aforesaid fixing means. Therefore, the starting position shown in FIGS. 13 and 14 changes to the position of FIGS. 15 and 16 in which the cinching lever -45- is applied against the band -25- moving it to the right (as in FIG. 15) relative to the pilot-support -46- and cinching and closing the mouth of the sack beyond what it already was by suspension or hanging from the hook -35- due to gravity.

Figure 17:
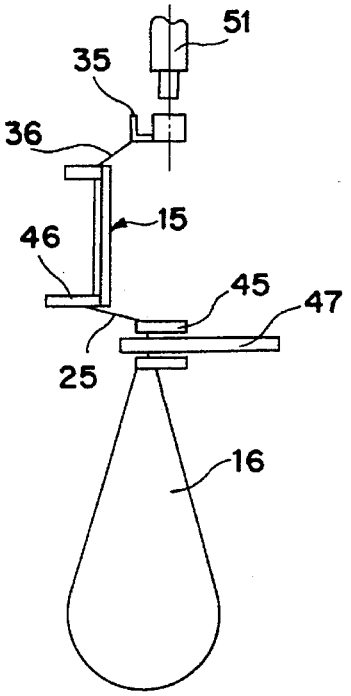
Figure 18:
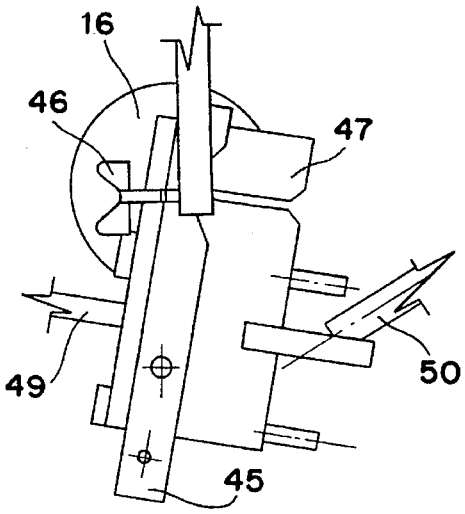

FIGS. 17 and 18 show another stage at which the sealing device -47- moves towards the band, retained by the cinching lever -45- by action of the drive means -49-, the relevant seal being applied on the band -25- in the sack next to its very mouth, thereby preventing the sack from opening by chance and indeed serving as safety means to prevent the unwanted opening of such sack, which, as aforesaid, could also have been achieved replacing the sealing device -47- with a clamping device, welding means or other suitable conventional means.

Figure 19:
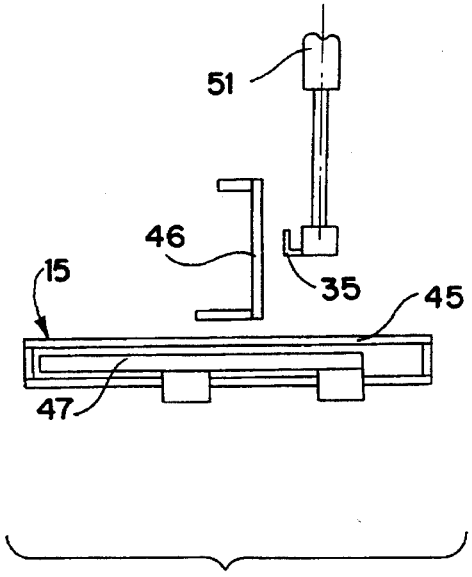
Figure 20:
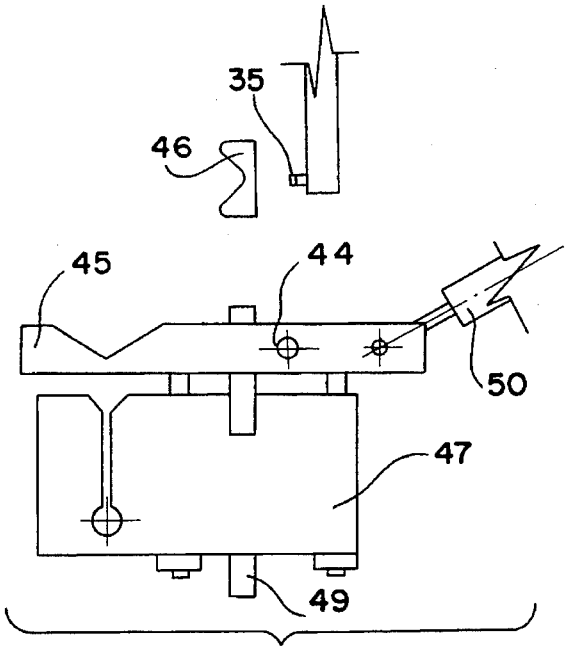
Figure 3:
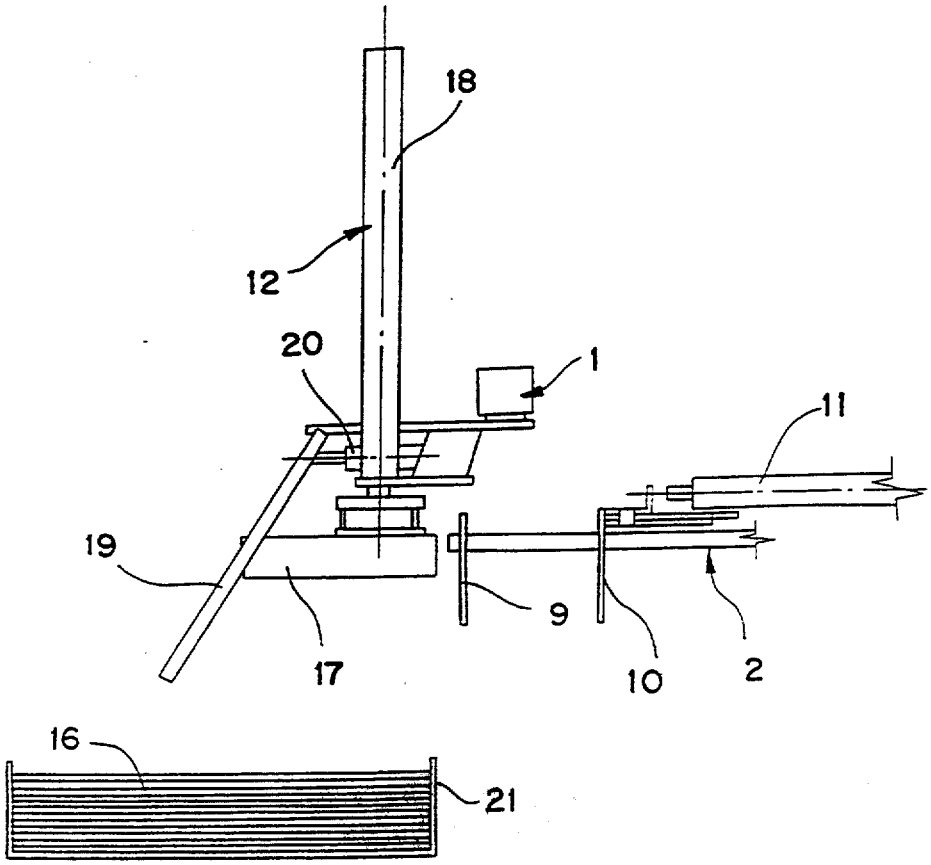
Figure 4:
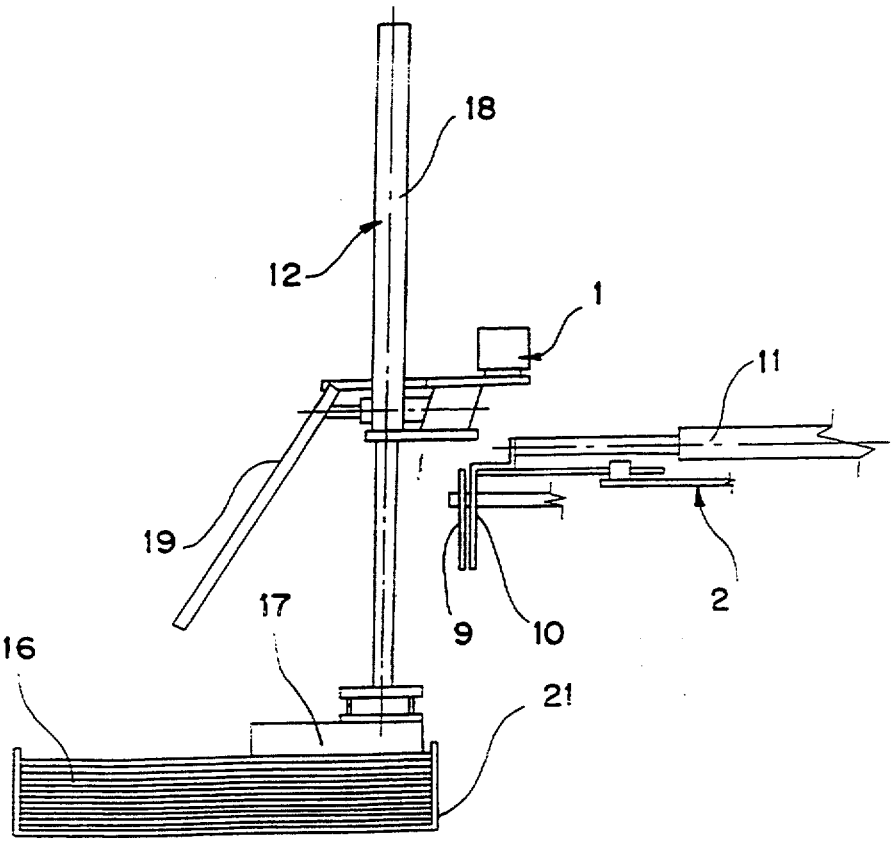
Figure 7:
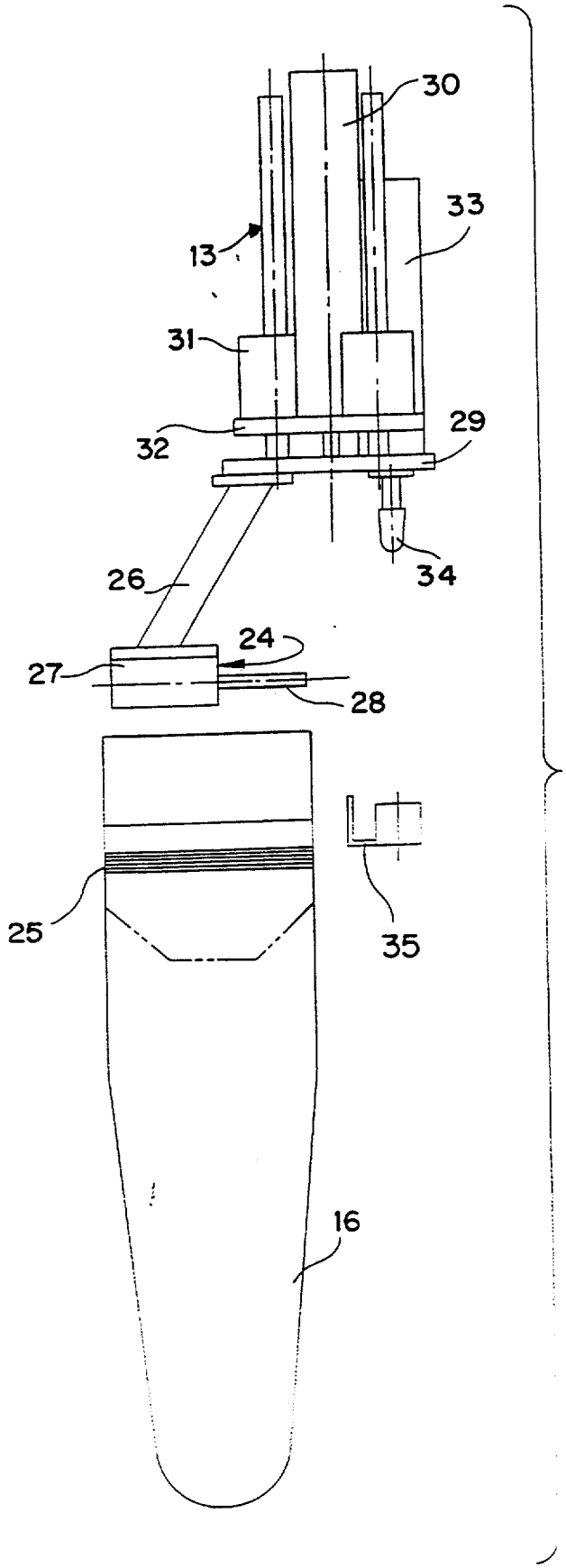
Figure 13:
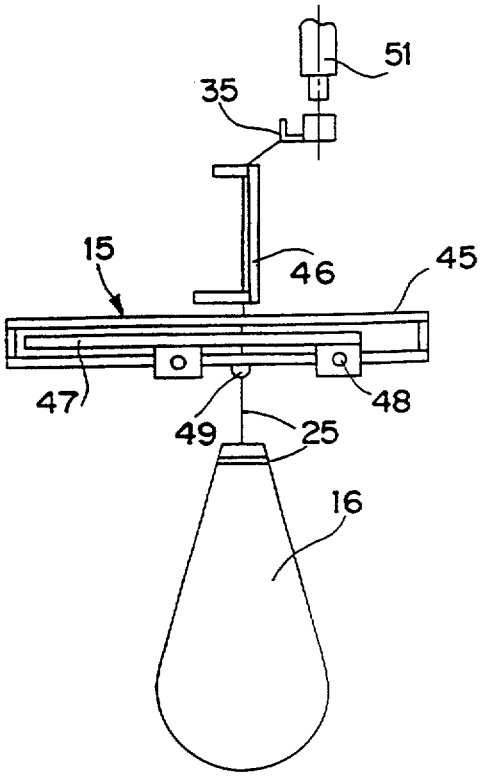
Figure 14:
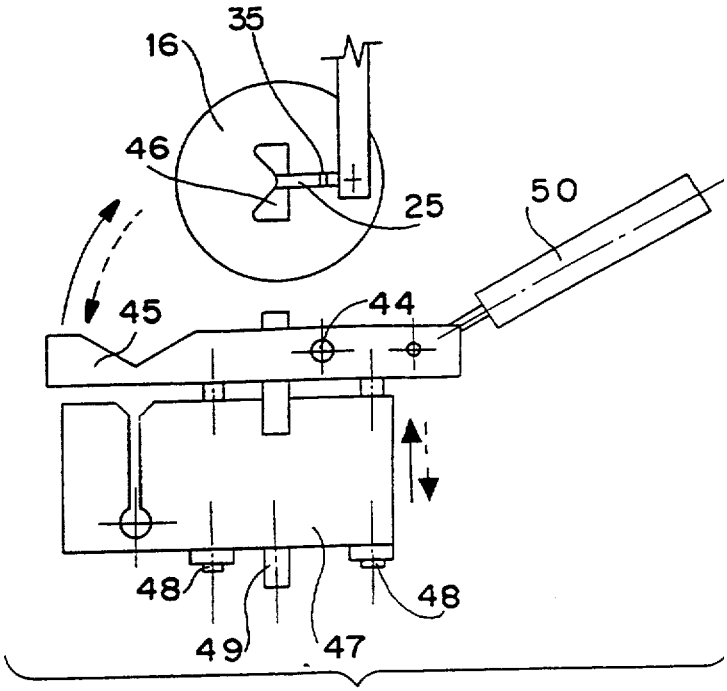
Figure 15:
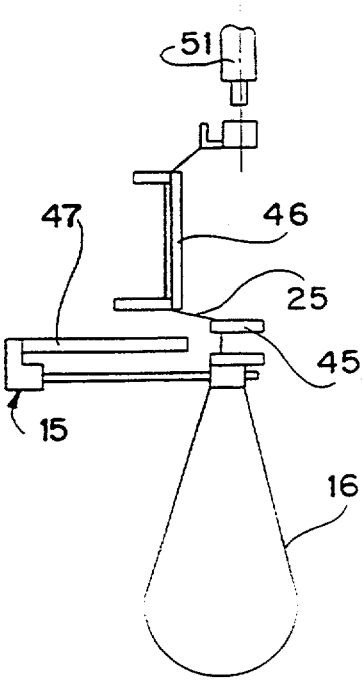
Figure 16:
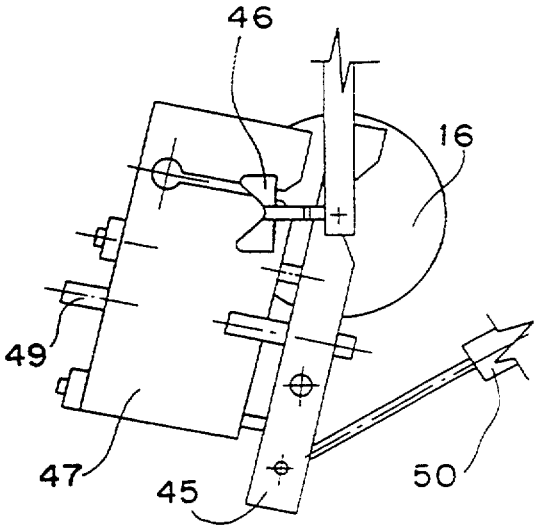

FIGS. 19 and 20 show the next stage at this closing station -15- at which the fixing means, viz. the cinching lever -45- and the sealing device -47- are moved inversely as before by the cylinder -50-. There are means for unleashing the loop -36- of the band -25- in the sack -16- (FIG. 17) from the hook -35-, which unleashing means comprise vertical line air drive means -51-, for instance a pneumatic or hydraulic cylinder, mounted upon the bed and, on being activated, moving the suspension or hook means -35- down against the antagonist action of resilient means and parallel to the said pilot-support -46-, in such a way that on reaching the height of the top part of the pilot-support and continuing to move down the loop -36- of the band in the sack is released and the sack, now full and with its mouth sealed, drops towards the outlet from the machine, which may have means for carrying the full and closed sacks outside the machine.

The sacks are thus filled, definitively closed with fixing means to ensure such seal and have suitable handles, initially defined by the loop of the band or the like and which shall have in the above-described operative stages become long enough to allow carriage by hand.

Operation of the machine can be easily inferred from the above description, in particular in relation to the attached drawings, noteworthy being that the cycle described is repeated for each arm of the turning support -2-, which receives the corresponding sack from the bucket -21- or -23- storing the sacks to be fed to the machine. The sacks may naturally be fed from other conventional means (conveyors and so forth) coordinated with the operation of the machine.

The drive means described can be any other conventional means whatsoever, and the machine may be fitted with physical protections for the user and activation of the drive means can be pneumatic, hydraulic or by any conventional mechanical systems. Control means will also be provided as required for the machine to operate, including safety means and the controls may be manual or automatic and include, if necessary, automation not only of the above machine operations, but of the entry of the sacks to the machine and outlet of the filled and sealed sacks, thereby economising and enhancing the yield of the machine. All the operations or operative stages may be controlled, adjusted and governed by suitable electrical, pneumatic, hydraulic, electronic and, as the case may be, combined means, and processor or preset or machine user developed programs may be incorporated. Sack presence detectors may also be disposed wherever required.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A machine for filling containers having holding bands, the machine comprising:

a rotatable support, the support having a plurality of arms;

a plurality of stations located adjacent ends of the arms of the support;

drive means for sequentially moving each of the arms to the plurality of stations;

loading means for loading the containers onto each of the arms of the support, the loading means being located at a container receiving station, the container receiving station being one of the plurality of stations;

loop forming means for forming a projecting loop from the holding bands of the containers, the loop forming means being located at a loop forming station, the loop forming station being one of the plurality of stations;

closing means for fixing a closure to a mouth of the container, the closing means being located at a closing station, the closing station being one of the plurality of stations;

the loading means loading a container to each arm when the arm is in the container receiving station, the arm with the container being moved from the container receiving station to the loop forming station and then to the closing station by the drive means.

2. The machine according to claim 1, further comprising a hopper located at a filling station, the filling station being one of the plurality of stations, the filling station being located between the loop forming station and the closing station with the containers being moved by the arms from the loop forming station, to the filling station and then to the closing station.

3. The machine according to claim 2, further comprising means for opening and closing the hopper such that the container is loaded when the hopper is opened, the means for opening and closing including a pivotable gate, each arm having a pair of blades for holding the container thereon, a portion of the gate being movable between the blades and into the container when the gate is opened and being pivoted from between the blades and out of the container when the gate is closed.

4. The machine according to claim 3, wherein the filling station further comprises a vertically displaceable platform located below the hopper, the container being engaged by the platform which is in a raised position before the gate is opened and is thereafter lowered as the container is filled.

5. The machine according to claim 4, wherein the platform is lowerable to a position beneath the container and out of engagement with the container when the container is filled, the platform further having vibratory means for vibrating the container.

6. The machine according to claim 2, wherein each of the arms has a pair of blades at the end thereof, the blades holding empty containers on the arms and the blades being movable relative to one another, the blades being movable toward one another to receive one of the containers and thereafter being moved away from one another to thereby engage an interior portion of the empty container to hold the empty container on the arm, the containers slipping from the blades when the containers are filled by the hopper.

7. The machine according to claim 6, further comprising a blade drive means on each of the arms for reciprocating the blades on the arm relative to one another, the blades being mounted on the arms generally perpendicular to a center line of the arms.

8. The machine according to claim 1, wherein four arms are provided as the plurality of arms, each of the arms having generally a same shape, adjacent arms being generally perpendicular, each of the arms being rotatable about a central axis and being rotated by the drive means, the arms being moved simultaneously.

9. The machine according to claim 1, wherein each arm of the plurality of arms has a pair of blades, the blades of each pair being reciprocable toward and away from one another, the container receiving station having means for lifting each container from a pile of container and placing the container between the blades, the blades thereafter being moved to engage an interior portion of the container to hold the container on the arm.

10. The machine according to claim 9, wherein each container has a mouth and wherein the means for lifting is reciprocable toward and away from the pile of containers, the means for lifting gripping the container adjacent the mouth and thereafter moving the container from the pile to a position whereat the blades are inserted through the mouth of the container, the machine further comprises a rocker arm mounted at the container receiving station adjacent the means for lifting, the rocker being pivotable about a shaft, the shaft being generally perpendicular to a center line of an arm at the container receiving station, rocker arm drive means being provided and being connected to the rocker arm for pivoting the rocker arm on the shaft to thereby engage the rocker arm with a portion of the container which is being moved by the means for lifting to thereby move the portion of the container to a position beneath the blades.

11. The machine according to claim 1, wherein the loop forming means comprises a support with a tab which is insertable into an opening of the container, the tab being horizontally movable within the container to engage the holding band on the container and thereafter push the holding band away from an exterior of the container, the tab being movable through a side of the container.

12. The machine according to claim 11, further comprising suspension means for suspending the containers, the suspension means receiving the holding band pushed from the container by the tab, the suspension means being vertically reciprocable, each of the arms having one of the suspension means mounted thereon.

13. The machine according to claim 12, wherein each of the arms has a pair of blades at the end thereof, the blades holding empty containers on the arms and the blades being movable relative to one another, the blades being movable toward one another to receive one of the containers and thereafter being moved away from one another to thereby engage an interior portion of the empty container to hold the empty container on the arm, the container slipping from the blades after the arm on which the container is mounted is moved from the loop forming station, the suspension means holding the containers by the holding band after the containers are slipped from the blades, weight of the container at least partially closing the containers whereafter the containers are moved to the closing station whereat the containers receive the closure.

14. The machine according to claim 13, further comprising a blade drive means on each of the arms for reciprocating the blades on the arm relative to one another, the blades being mounted on the arms generally perpendicular to a center line of the arms.

15. The machine according to claim 13, further comprising first suspension drive means for initially lowering the suspension means before the band is inserted thereon and then raising the suspension means to receive the band after the tab pushes the band from the container, and second suspension drive means for lowering the suspension means at the closing station to release the band from the suspension means.

16. The machine according to claim 11, further comprising suspension means on each arm for receiving the band of the container and wherein the closing means includes a cinching lever, a pilot support and a sealing device, the cinching lever being rotatable about a generally vertical axis, the sealing device being reciprocally mounted on the cinching lever, the band of the container initially engages the pilot support whereafter the cinching lever is rotated to engage and pull the band of the container, the sealing device then being movable toward the cinching lever to place the closure at the mouth of the container, the machine further comprises means for releasing the band from the suspension means after the closure is applied to the mouth of the container, the means for releasing vertically reciprocates the suspension means.

17. The machine according to claim 16, further comprising means for collecting the containers from the closing station.

18. The machine according to claim 1, wherein the containers are reticulate sacks and the holding bands are continuous, flexible bands affixed to the sacks about the mouth of the sacks, and the machine further comprising:

a hopper located at a filling station, the filling station being one of the plurality of stations, the filling station being located between the loop forming station and the closing station with the sacks being moved by the arms from the loop forming station, to the filling station and then to the closing station;

suspension means for suspending the sacks, the suspension means receiving the holding bands of the sacks at the loop forming station; and a pair of blades on an end of each of the arms, the blades holding empty sacks on the arms and the blades being movable relative to one another, the blades being movable toward one another to receive one of the sacks and thereafter being moved away from one another to thereby engage an interior portion of the empty sack to hold the empty sack on the arm, the sack slipping from the blades after the arm on which the sack is mounted is moved from the loop forming station, the suspension means holding the sack by the holding band after the sacks are slipped from the blades, weight of the sack at least partially closing the sacks whereafter the sacks are moved to the closing station whereat the sacks receive the closure.

19. The machine according to claim 1, further comprising:

at least one blade on each arm, the at least one blade being insertable into an empty container to hold the container on the arm; and suspension means for receiving the holding band of the container, the container being removed from the at least one blade to thereafter be suspended from the suspension means, weight of the container at least partially closing the mouth of the container when the container is suspended by the suspension means.

* * * * *

UNITED STATES PATENT AND TRADEMARK OFFICE

CERTIFICATE OF CORRECTION

PATENT NO. : 5,457,930

DATED : October 17, 1995

INVENTOR(S) : Agustin DAUDER-GUARDIOLA

It is certified that error appears in the above-indentified patent and that said Letters Patent is hereby corrected as shown below:

In Figure 3, reference numeral "19" should be reference -- 9--.

In Figure 7, the reference line "13" should have a dart; and

Figure 14:
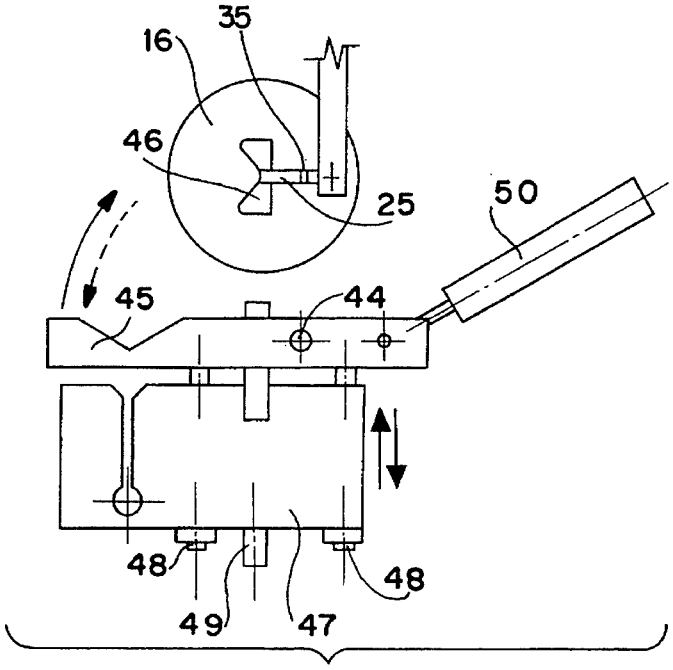
Figure 15:
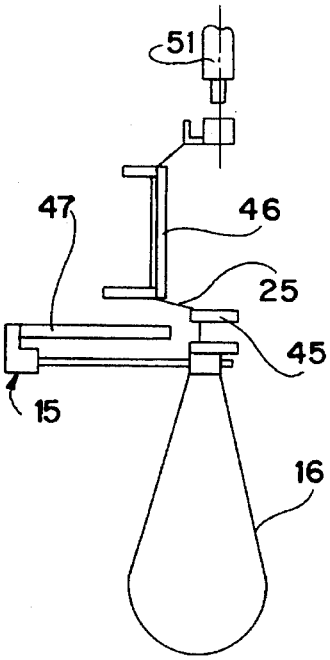
Figure 16:
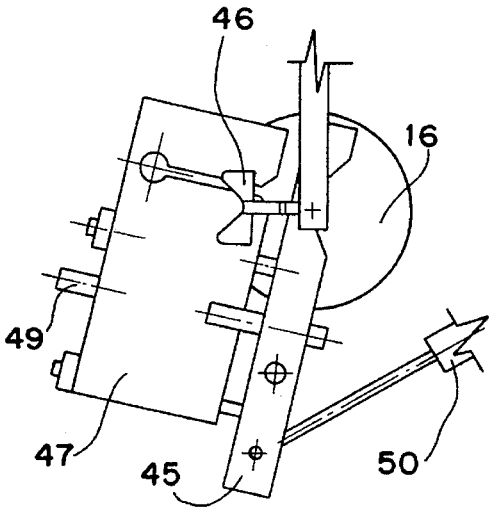

In Figure 14, the downward line adjacent the sealing device 47 should be shown in dotted lines.

The sheets of Drawings consisting of Figures 3, 7, and 14 should be replaced by the attached sheets.

Signed and Sealed this

Sixteenth Day of April, 1996

Bruce Lehman

*Attest:*

BRUCE LEHMAN

*Attesting Officer*

*Commissioner of Patents and Trademarks*